310-13 SR
FIP8502 XR 4,245,917

United States Patent [19]
Mosciatti et al.

[11] 4,245,917
[45] Jan. 20, 1981

[54] LINEAR ACTUATOR DRIVEN PRINTER

[76] Inventors: Roger Mosciatti, 6 Wycomb Pl., Coram, N.Y. 11727; Thomas P. Foley, 12 Janes La., Lloyd Harbor, N.Y. 11743; Frederick G. Moritz, 20 Aberdeen Rd., Hauppauge, N.Y. 11787

[21] Appl. No.: 16,205

[22] Filed: Feb. 28, 1979

[51] Int. Cl.[3] ..... B41J 1/08
[52] U.S. Cl. ..... 400/144.2; 400/322; 400/144.3; 310/13
[58] Field of Search ..... 400/144.2, 144.3, 163, 400/163.1, 184, 185, 219.5, 225, 220, 568, 322, 477; 310/12, 13, 14, 29

[56] References Cited

U.S. PATENT DOCUMENTS

| | | | |
|---|---|---|---|
| 2,902,136 | 9/1959 | Whippo | 400/219.5 |
| 3,509,981 | 5/1970 | Hylan et al. | 400/323 X |
| 3,596,745 | 8/1971 | Waldenburger | 400/477 X |
| 3,696,204 | 10/1972 | Wallskog | 400/322 X |
| 3,723,780 | 3/1973 | Gillum | 310/13 |
| 3,995,547 | 12/1976 | Shimodaira et al. | 400/184 X |
| 4,059,775 | 11/1977 | Warmka | 310/12 |
| 4,062,436 | 12/1977 | Kondur et al. | 400/185 X |
| 4,072,101 | 2/1978 | Garcia et al. | 400/322 X |
| 4,081,723 | 3/1978 | Vetter et al. | 101/181 |
| 4,149,808 | 4/1979 | Malthias et al. | 400/144.2 |

*Primary Examiner*—Edward M. Coven
*Attorney, Agent, or Firm*—Darby & Darby

[57] ABSTRACT

A high-speed printer includes a standard printing element, such as a daisy wheel, a paper feed mechanism and a ribbon feed mechanism. All of these various devices are controlled by a single linear actuator which comprises an elongated cylindrical magnet, C-shaped in cross-section, through which a ferrous core axially extends. A plurality of separate armatures envelope the core in the air gap between the magnet and core and are adapted to move linearly upon application thereto of a control current. The armatures control, respectively, the movement of the carriage containing the printer element, the rotation of the printer element, the advancement of the paper feed mechanism and the incremental positioning in both directions of the ink ribbon.

7 Claims, 9 Drawing Figures

LINEAR ACTUATOR DRIVEN PRINTER

This invention relates to high-speed printers. More specifically, this invention relates to a high-speed printer wherein the mechanical movements of the various parts are controlled by a single elongated linear actuator.

BACKGROUND OF THE INVENTION

Conventionally high-speed printers include a printer assembly or carriage which moves from left to right across the paper on which it is to print. Printing may occur in either or both directions. The paper is advanced automatically as is the ribbon containing the ink used to form the characters by actuation of the print head. A common print head is a matrix head wherein a vertical array of pins are actuated to create dots which form a selected character. Another common printing element is a daisy wheel which contains each of the characters to be printed and which is moved left to right on a carriage. At the same time, the wheel is rotated so as to position a selected character in front of a solenoid actuated plunger which causes the selected character of the daisy wheel to strike the ink ribbon and paper to form an impression.

In known printer constructions, each of these separate movements is controlled separately. Where linear motion is required, a standard rotary motor is used in combination with belts, pulleys or gears to convert the rotary output to linear movement. In view of the high-speed operation required, the driving mechanisms required are generally costly and complex.

OBJECTS OF THE INVENTION

The principal object of this invention is to provide a high-speed printer with performance criteria comparable to prior art printers yet which is less expensive and simpler to construct.

A more specific object of the invention is to provide a high-speed printer wherein a single linear actuator is used to provide the power for all of the various movements required in the printer.

BRIEF SUMMARY OF THE INVENTION

A printer construction comprises a printer carriage assembly, a paper feed mechanism and an ink ribbon drive system. In accordance with the preferred embodiment, the printer assembly comrises a daisy wheel which is moved linearly with respect to the paper and, also, rotated to position a character in front of a solenoid operated plunger. An actuator comprises a cyclindrical magnet, C-shaped in cross-section, extending across the width of the printer. A ferrous core extends axially through the magnet with the magnet flux paths being completed by a pair of endpieces. There is a separate armature, independently controlled and moveable within the air space between the core and magnet for the printer carriage, the paper advance mechanism and the ribbon feed mechanism. In the case of a daisy wheel type printer, a separate armature is provided to rotate the daisy wheel as it is moved linearly Each armature is connected to a web which includes bearing means engaging two guide rods extending the width of the printer. The webs serve as an output member from which power may be taken and, at the same time, support the respective armatures in a preselected position relative to the central core and magnet.

THE DRAWINGS

DETAILED DESCRIPTION

FIGS. 1–8 show the mechanical details of a preferred embodiment of the invention in which a standard daisy wheel is used as the printer element. The printer consists essentially of a linear actuator, a carriage which positions the daisy wheel relative to the paper (including appropriate rotation of the daisy wheel), a paper feed mechanism and a ribbon transport. The linear actuator serves as the drive means for each of these devices which are separately described below.

Figure 1A:
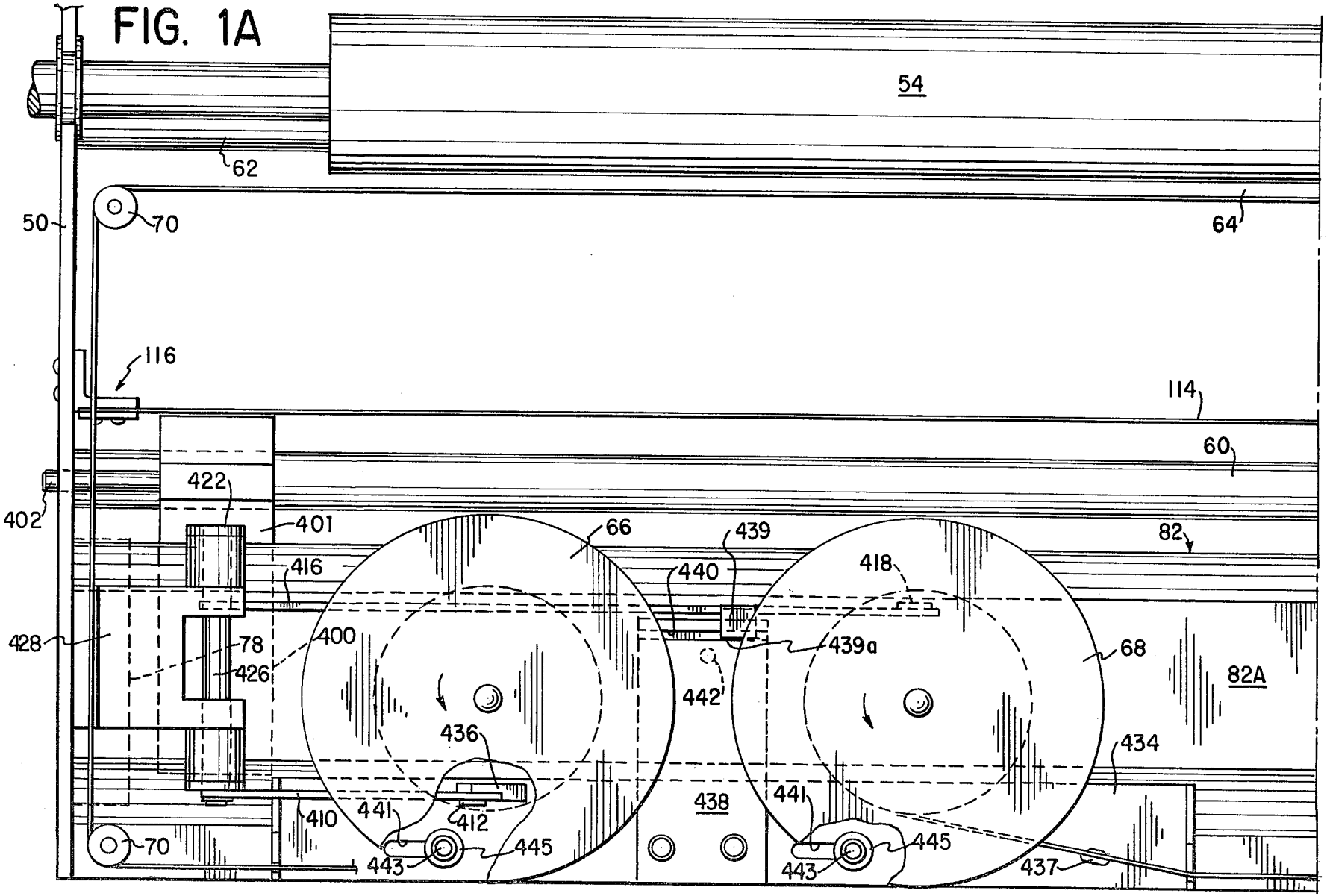
FIG. 1A is a plan view of the left side of a printer according to the invention.
Figure 1B:
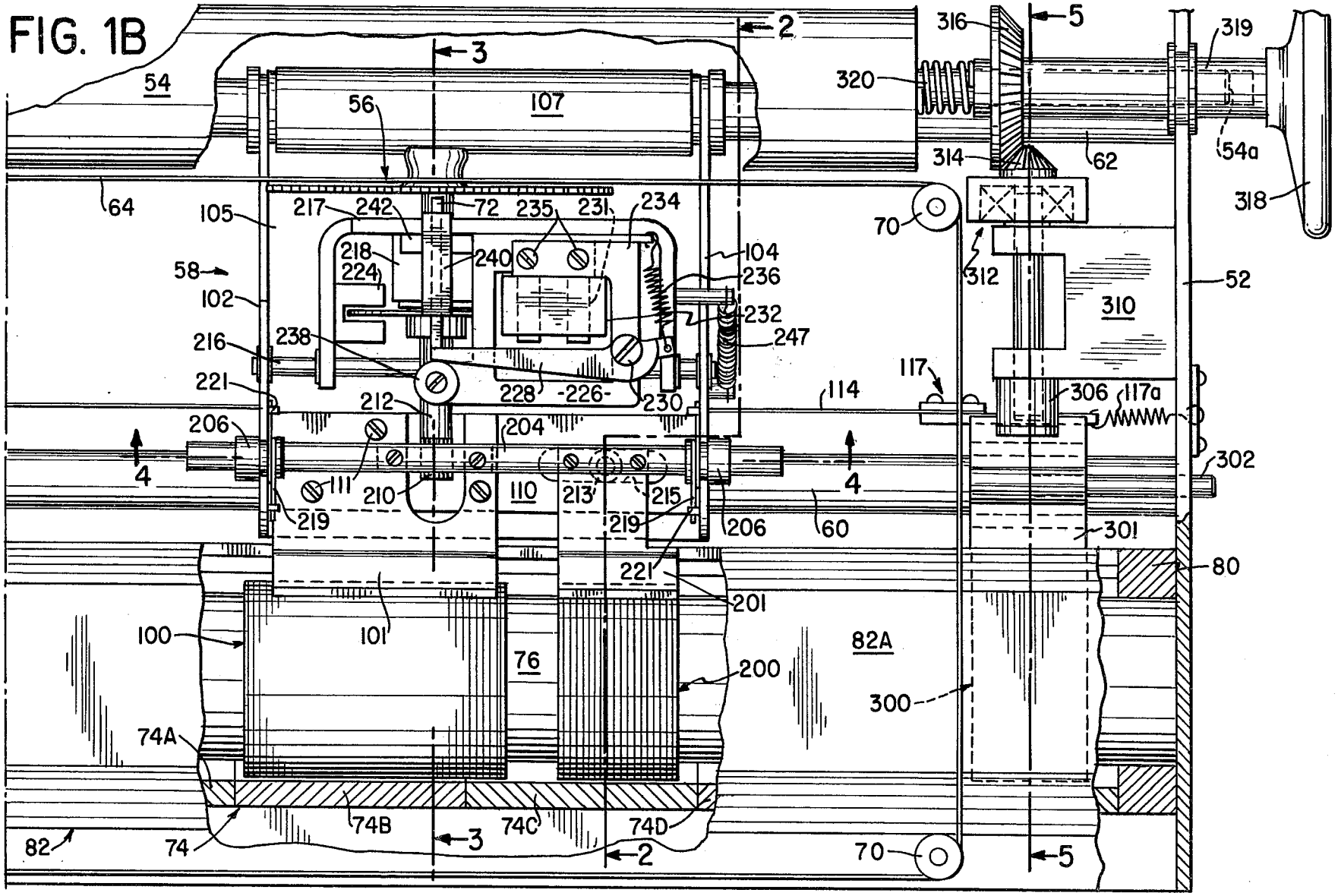
FIG. 1B is a plan view of the right side of the printer.

Referring now to FIGS. 1A and 1B, the printer includes a base frame (not numbered) from which left and right walls 50 and 52, respectively, extend vertically. A paper roller 54 is suitably journaled in the walls 50 and 52. A daisy wheel 56 is rotatably supported on a printer carriage 58 which moves laterally between the walls 50 and 52 on two guide rods 60 and 62, each of which is supported at its opposite ends in the walls 50 and 52. A printing ribbon 64 passes between the paper roller 54 and the daisy wheel 56 to enable imprinting on the paper. The ribbon 64 is fed from and to spools 66 and 68 by four guide wheels 70 which defined a rectangular loop.

The printer operates by moving the carriage 58 from left to right while the daisy wheel 56 is rotated to position a selected character in front of a plunger 72 which can be actuated to force the daisy wheel 56 and ink ribbon 64 against the paper mounted on the roller 54 at a time when carriage 58 and daisy wheel 56 are at rest. During the printing operation, the ribbon transport mechanism moves the ribbon 64 continuously so that a fresh section of the ribbon is available for each imprint. At the end of each printed line, the paper is advanced by a paper feed mechanism.

In accordance with the invention, all of these mechanical movements are derived from a single linear actuator. In the preferred embodiment of the invention, the linear actuator comprises a C-shaped magnet 74 enveloping a steel core 76. The magnet 74 and core 76 extend substantially the entire distance between walls 50 and 52 with the magnetic circuit being closed at opposite ends by annular endpieces 78 and 80. Magnet 74 may actually comprise a plurality of axially aligned magnets 74A,74B,74C, etc (see FIG. 1B).

In accordance with the invention, four separate armature coils 100,200,300 and 400 are mounted on suitable bobbins (not numbered) for axial movement independently of each other along the core 76. Armature 100 moves the printer carriage 58 laterally while armature 200 rotates the daisy wheel 56. The armature 300 provides the paper feed by rotating the paper roller 54 and the armature 400 feeds the ink ribbon 64 past the daisy wheel by selectively rotating either the spool 66 or 68.

Figure 2:
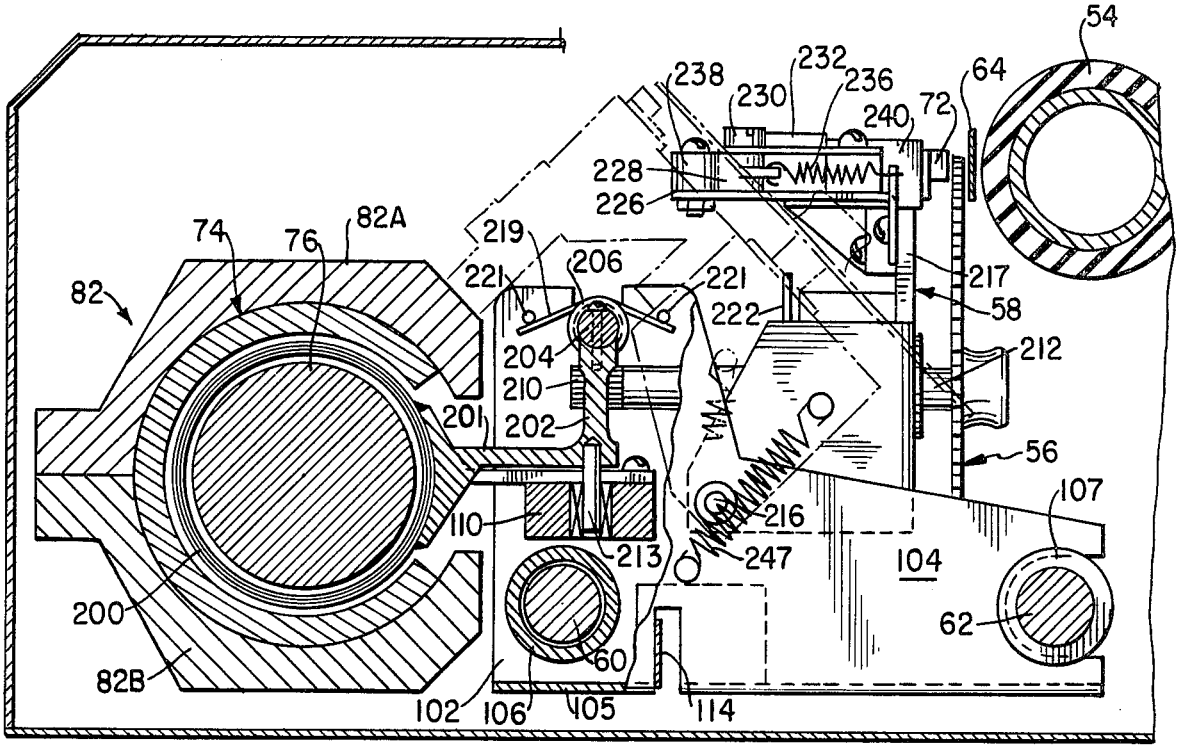
FIG. 2 is a cross-sectional view along the line 2—2 of FIG. 1B.
Figure 3:
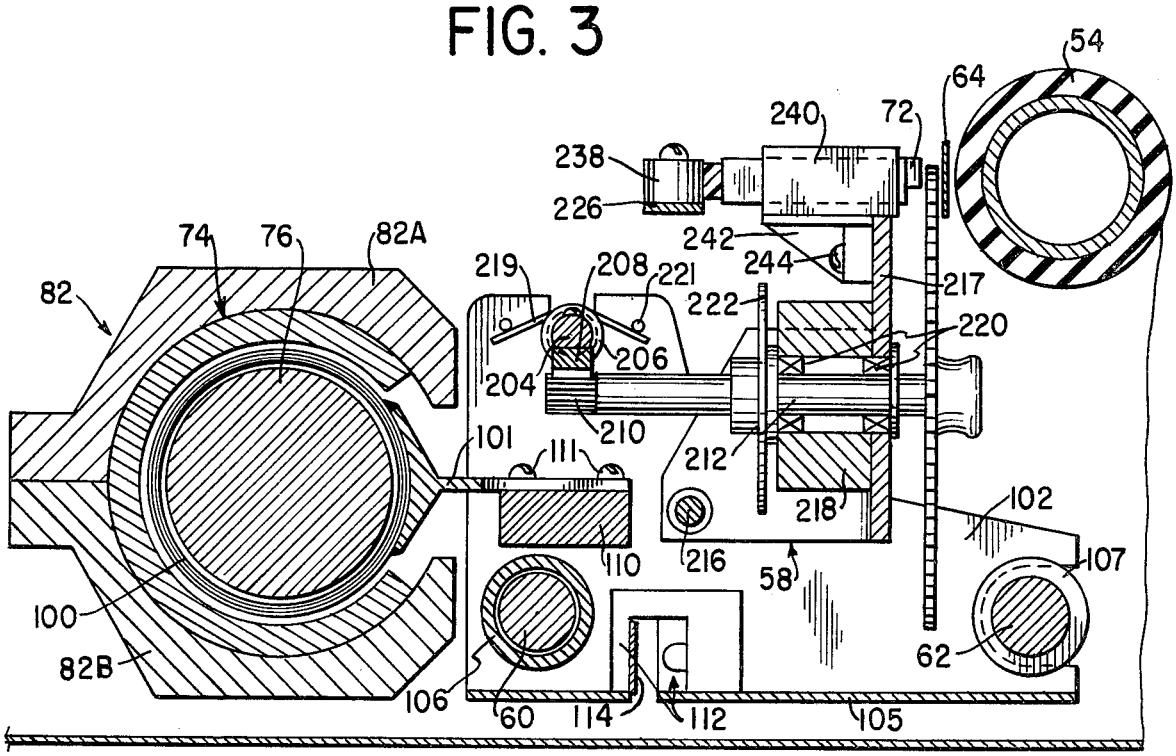
FIG. 3 is a cross-sectional view along the line 3—3 of FIG. 1B.
Figure 4:
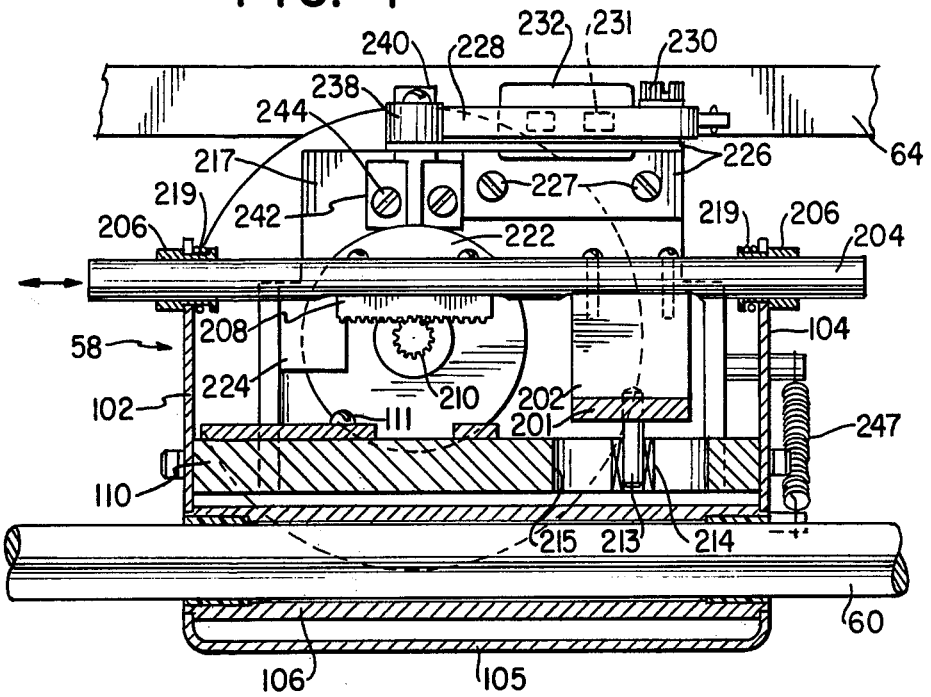
FIG. 4 is a front sectional view along the line 4—4 of FIG. 1B.
Figure 8:
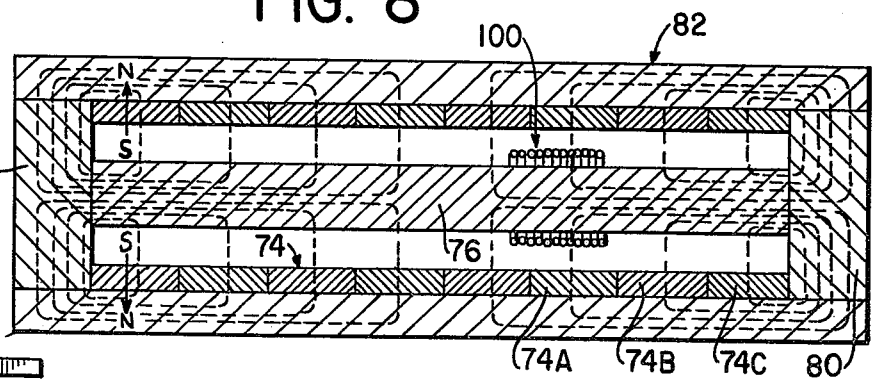
FIG. 8 is a schematic illustration showing the magnetic flux paths which exist in the linear actuator of the invention.

The operation of the linear actuator is explained with reference to FIG. 8. As represented in FIG. 8, the lines of flux (shown in dotted lines) from magnets 74A,74B,74C, etc. cross the air gap between the magnet and core 76, enter the core and return through the annular endpieces 78 and 80. The return path includes an outer ferrous shell 82 which may actually consist of upper and lower sections 82A and 82B as shown in FIG. 2. If a current is passed through the armature 100, a force is applied to the armature causing the armature to move left or right depending on the direction of the applied current.

The principle of operation of the linear actuator is more fully described in U.S. patent application Ser. No. 16,193, filed concurrently herewith and assigned to the assignee of this application.

The C-shaped permanent magnets 74A,B,C, etc., may be made of barium ferrite having polarity as indicated in FIG. 8. The core 76, annular members 78 and 80, and shell 82 may be made of soft steel. Each of the armatures 100,200,300 and 400 comprises a series of turns of insulated copper wire wound on a bobbin which is coaxial with (but not in contact with) core 76. This relationship is maintained by the web members as explained below. There is a web member for each armature and each web member (illustrated at 101,201,301 and 401) extends through the slot in the magnet 74 to mechanically couple the armature to the various driving mechanisms of the printer. The webs also physically support the armatures in the desired spaced apart relationship with core 76. The armatures are attached to the respective web members by an adhesive having a high thermal conductivity such as ECCOBOND 281. This enables the conduction of heat directly from the copper windings of the armature to the web members for dissipation within the body of the printer.

The construction as described above is typical of each of the armatures 100,200,300 and 400, each of which is described separately below.

Carriage Transport (FIGS. 1B,2,3 and 4)

The printer carriage 58 which supports the daisy wheel 56 comprises left and right end plates 102 and 104, respectively, extending upwardly from an integral base sheet 105. A pair of horizontal tubular sleeves 106 and 107 extend between the end plates 102 and 104 slightly above the base sheet 105 of the carriage. The main guide rods 60 and 62 pass through sleeves 106 and 107, respectively, with suitable bearings and/or lubrication provided to minimize friction.

A horizontal support bar 110 also extends the width of the carriage just above the sleeve 106. The carriage transport web 101 is secured to bar 110 by suitable fasteners 111. When a current is fed to the armature 100, the linear movement of this armature thus causes left-right movement of the carriage 58 by means of the web 101 and the horizontal bar 110.

The left-right position of the carriage 58 is monitored optically by a standard photosensitive device 112, attached to the carriage, and responsive to the position of the carriage relative to an encoded strip 114 as the carriage moves laterally. The encoded strip 114 is positioned by suitable fastener devices 116,117. Fastener device 117 also comprises spring element **117*a* to produce tension along the length of the encoded strip 114**.

Print-Font Rotation Assembly (FIGS. 1B,2,3,4)

The print-font rotation armature 200 is secured to a web 201 (FIG. 2) which terminates in an integrally formed vertical wall 202. A horizontal rod 204 is secured to the top of the wall 202 by suitable fasteners (not numbered) and the shaft is journaled in bushings 206 within the carriage walls 102 and 104. Thus, application of a current to the font rotation armature 200 causes left-right horizontal movement of the rod 204.

A rack 208 is attached to the bottom of a flat central section of the rod 204 and engages a pinion 210 which is formed on the innermost end of a shaft 212 on which the daisy wheel 56 is removably mounted. To enhance stability, a vertical pin 213 extends downwardly from wall 202 into a bushing 214 which slides within a slot 215 within the horizontal bar 110.

To minimize backlash between the rack 208 and pinion 210, a constant bias is applied to the horizontal rod 204 urging rack 208 downwardly against the pinion 210. This force is provided by a pair of springs 219 which are wrapped around opposite ends of the bushings 206 just inside the carriage walls 102 and 104 and retained by respective pairs of projections 221. The bias minimizes any looseness or play between the gears which helps to reduce any backlash which might otherwise occur because of the rapid starting and stopping movements of the carriage.

The assembly which supports the daisy wheel 58 includes a bracket 217, U-shaped in FIG. 1B, adapted to pivot vertically about a shaft 216 supported in the end plates 102 and 104 of carriage 58. A cylindrical mounting block 218 (FIG. 3) is fastened to the inner surface of bracket 217 and supports a pair of bearings 220 in which the shaft 212 is journaled.

An encoder wheel 222 is also secured to shaft 212 and rotates with the daisy wheel 56 to provide an input signal to the microprocessor which controls the linear actuator to rotate the daisy wheel. Generally, the encoder wheel 222 will be read by standard photoelectric transducers retained within housing 224 attached to the inner surface of the bracket 217.

The apparatus for actuating the plunger 72 to cause the daisy wheel to print may be conventional. This apparatus includes a horizontal base plate 226, having a square cutout section in its center, secured to bracket 217 by fasteners 227. The left end of an elongated actuator arm 228 engages the rear end of the plunger 72 which slides in a housing 240 supported on a bracket 242 secured to bracket 217 by fasteners 224. The arm 228 is pivotally supported at its right end on the base plate 226 by an appropriate fastener means 230. The movement of arm 228 is controlled by an electromagnet comprising a U-shaped core 231 and a coil 232 fastened to the core. The electromagnetic core 231 is clamped onto plate 226 by a U-shaped retaining member 234 and fasteners 235.

A spring 236 biases the left-hand end of the actuator bar 228 against a stop post 238 extending upwardly from a left-hand projection on the plate 226.

As indicated above, the actual printing operation in the preferred embodiment of the invention may be conventional after the daisy wheel has been properly positioned in accordance with the invention. Energization of the coil 232 causes the actuator bar 228 to pivot clockwise (FIG. 1B) which, in turn,. moves the plunger 72 toward the daisy wheel causing the selected character to strike the ribbon 64 and make the appropriate imprint on the paper.

To change the daisy wheel, the entire bracket 217 may be pivoted about the shaft 216 as shown in phantom lines in FIG. 2. In this open position, the daisy wheel may be readily replaced. The coil spring 247 tends to hold the bracket 217 in either its fully opened or fully closed position.

Figure 5:
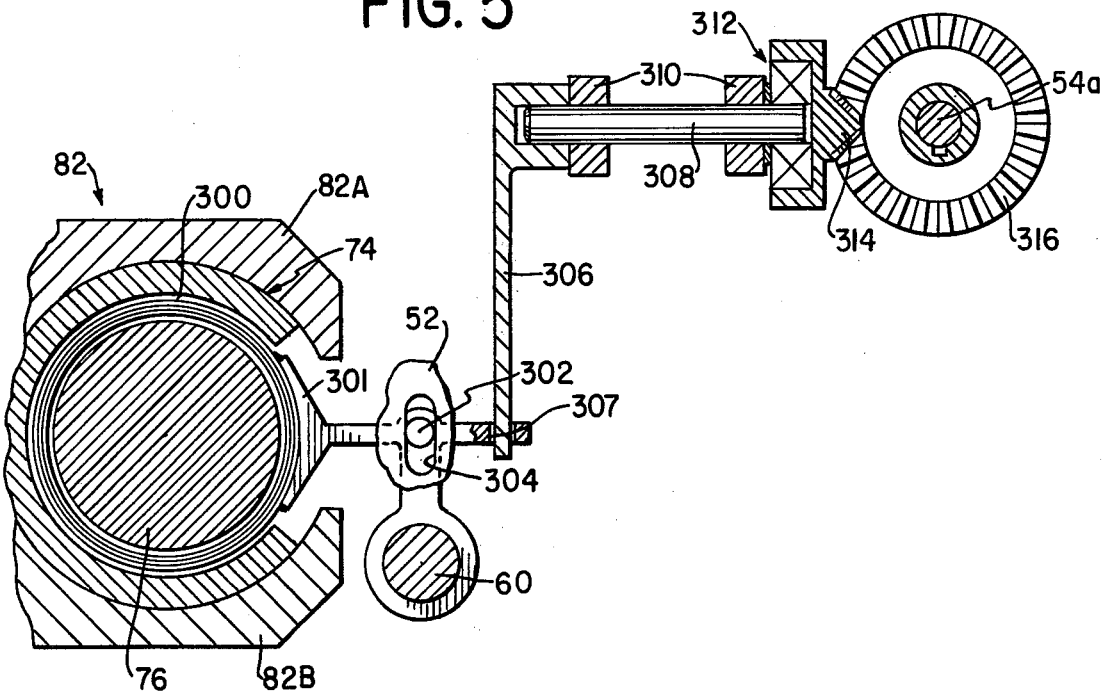
FIG. 5 is a side sectional view along the line 5—5 of FIG. 1B.

Paper Feed Mechanism (FIGS. 1B and 5)

The paper feed armature 300 is attached to a paper feed web 301 which includes a vertical projection (not numbered) extending downwardly and adapted to ride on the guide rod 60. A horizontal pin 302 extends into a vertical slot 304 within the wall 52 to further stabilize the linear movement of the armature 300 and, in particular, to ensure that the armature will not contact the core 76 as the armature moves.

A crank 306 extends through a slot 307 in the inner end of web 301. At its upper end, the crank is fastened to an axle 308 which is rotably supported in a bifurcated axle support 310 secured to the inner surface of wall 52. Thus, left-right movement of the web 301 will cause crank 306 and axle 308 to oscillate.

A conventional one-way clutch 312 connects axle 308 to bevel gear 314. The bevel gear 314 engages a driving gear 316 which causes rotation of the driving roller 54. The input to the one-way clutch is taken from the axle 308 and the clutch 312 converts the oscillatory movement of the axle 308 into a unidirectional movement of the bevel gear 314 so as to continuously advance roller 54 in stepwise increments.

The automatic drive may be overriden by pushing on a manual control knob 318 which is fastened to a tubular sleeve 319 splined to the support shaft 54A of the roller 54. A coil spring 320 biases sleeve 319 outwardly so as to maintain the gears 314 and 316 normally in engagement. When the knob 318 is pushed inwardly, the gears are disengaged and the operator may then manually position the roller.

Figure 6:
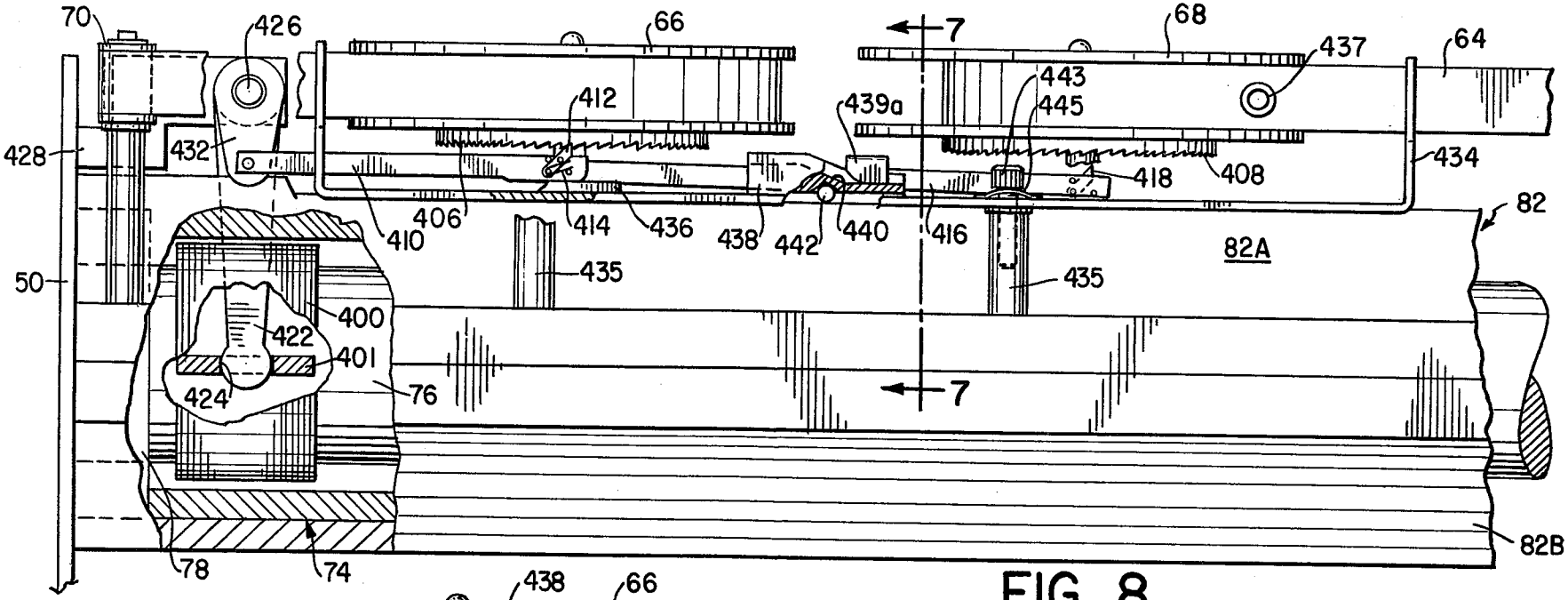
FIG. 6 is a front view of the left side of the printer mechanism showing the ribbon feed mechanism.
Figure 7:
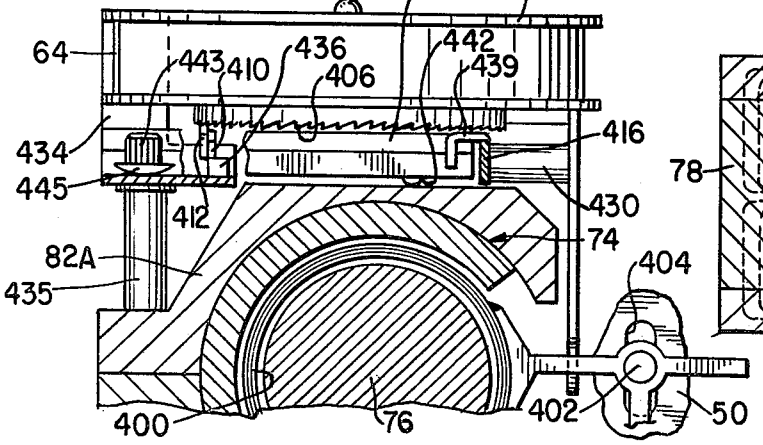
FIG. 7 is a side sectional view along the line 7—7 of FIG. 6.

Ribbon Advance (FIGS. 1A, 6 and 7)

The ribbon advance armature 400 is secured to a web 401 which slides laterally on guide rod 60 (not shown in FIG. 7) in the same way as the webs 101, 201 and 301. A horizontal pin 402 extends from web 401 into a slot 404 in wall 50 to provide a two point support for the armature and web.

The spools 66 and 68 each serve alternately as take-up and supply spools. As shown for representative purposes, spool 68 is the supply spool and spool 66 is the take-up spool. The take-up spool (in the example, spool 66) is being driven by the left-right oscillation of the web 401. When ribbon 64 reaches the end of its travel, the driving mechanism is reversed, as described below, and spool 68 is driven as the take-up spool to feed the tape wound on spool 66.

Ratchet wheels 406 and 408 serve as the drive hubs of spools 66 and 68, respectively. A reciprocating actuator bar 410 includes a pawl 412 biased upwardly by a torsion spring 414. This actuator mechanism drives ratchet 406 (and hence spool 66) in a counterclockwise direction (as viewed in FIG. 1A) when the actuator mechanism is lifted upwardly into the position shown in FIG. 6.

Likewise, a similar actuator mechanism including an actuator bar 416, pawl 418 and a spring (not shown) drives ratchet wheel 408 in a clockwise direction when the actuator mechanism is lifted so that the pawl 418 engages the ratchet 408. In the illustrated example the spool 66 is being driven so that, as shown in FIG. 6, the actuator bar 410 is raised whereas the actuator bar 416 is lowered.

The ribbon advance web 401 drives the actuator bars 410 and 416 through an intermediate vertical arm 422, the lower end of which is rounded and received within an appropriately shaped aperture 424 within web 401. The top of arm 422 is secured to an axle 426 which is rotatably supported in axle mount 428 fastened to the left-hand printer wall 50. The actuator bar 416 is attached to the arm 422 by means of a short horizontal pin 430 (see FIG. 7). Actuator bar 410 is linked to an arm 432 which extends downwardly from the end of axle 426 opposite the end to which arm 422 is attached. In both cases, the actuator bars 410 and 416 are pivotally attached to the driving mechanism so that the bars will move horizontally as the armature 400 causes the arm 422 to oscillate about axle 426.

The mechanism for coupling the actuator bars 410 and 416 to the respective ratchet wheels 406 and 408 comprises a shiftable member 434 which can be moved from left to right. The shiftable member 434 is supported on posts 435 which are in turn fixed to the upper half 82A of the ferrous shell 82. Elongated slots 441 in shiftable member 434 provide for left-right motion while screws 443 and spring washers 445 create enough friction to keep the shiftable member 434 in either the left-hand or right-hand position. In the drawings, shiftable member 434 is shown in its extreme left-hand position in which the actuator bar 410 is lifted by means of a cam or ramp 436 to cause pawl 412 to engage ratchet wheel 406. In this extreme left-hand position, bar 416 is allowed to fall so that ratchet wheel 408 is disengaged.

Shift member 434 includes upwardly extending vertical ends each of which includes a slot (not numbered) through which the ribbon 64 passes. At each end of the tape there is an eyelet 437 which is unable to pass through the slot in the shift member and therefore causes the shift member to move to the right (when the spools 66 and 68 rotate counterclockwise) or the left (when the spools rotate clockwise). In the example illustrated, when eyelet 437 strikes the shift member 434, shift member 434 is moved to the right until the cam 436 clears the actuator bar 410 and the actuator bar 410 drops to the floor of the shift member.

A second cam member 438 is fastened to shift member 434 and extends horizontally inwardly into engagement with a U-shaped cam follower 439 which is part of actuator bar 416. The free arm 439 A of cam follower 439 is adpated to ride up a ramp surface 440 of the second cam 438 as the shift member moves from left to right. The second cam member 438 may be supported at its inner end by a bearing ball 442 or the like which rides on top of the shell 82.

The electronic circuitry for controlling the individual armatures forms no part of this invention and therefore is not described herein. The reciprocating armatures 300 and 400 will require a simple polarity reversal at each extreme of movement. In the case of armature 100 (and possibly armature 200) it will be desirable to control the speed for reasons explained in our aforesaid concurrently filed application Ser. No. 16,193, which is directed to the linear actuator and the control thereof.

Control of velocity (and actuation of the bar 228 which causes printing) may be dependent on the position encoded pulses from photosensor 112. To the extent an understanding of these functions is required to understand this invention, that application is incorporated herein by reference.

What is claimed is:

1. A printer, comprising a linearly movable carriage having a printing element mounted thereon, paper advance means for advancing a writing surface relative to said printing element, second advance means for advancing an ink bearing member relative to said printing element and a linear actuator for moving said carriage and actuating said paper advance means and said second advance means, said linear actuator comprising an elongated C-shaped magnet defining a cylindrical interior space, a cylindrical ferrous core extending axially through said space to form an air gap between said core and the magnet, ferrous end pieces at the end of said magnet, at least three independently controlled axially movable armatures, each of said armatures comprising coils of wire wrapped around said cylindrical core and being movable axially within said air gap when an electrical current is caused to flow through the coils of said armature, first, second and third connecting members attached, respectively, to said three armatures and extending radially through the open portion of said magnet, said first connecting means being connected to said carriage, said second connecting means adapted to actuate said paper advance means and said third connecting means adapted to actuate said second advance means.

2. A printer according to claim 1, including at least one guide rail extending across said printer, with each connecting member including bearing means for engaging at least one guide rail, said connecting members holding their respective armatures in the air gap between said core and magnet.

3. A printer according to claim 1, wherein said printing element comprises a rotatable daisy wheel and wherein said linear actuator includes a fourth armature and means connected to said fourth armature for rotating said daisy wheel.

4. A printer according to claim 3, wherein said means for rotating comprises a horizontally movable rack slidably mounted in said carriage, a web member attached to the armature and rack, and a pinion connected to said daisy wheel.

5. A printer according to claim 1, 2 or 3, further including a crank pivotally mounted at one end and connected at its other end to the connecting means for actuating said paper advance means, and a one-way clutch connected to said one end of the crank for converting the crank's oscillatory movement to a step-wise incremental movement in one direction.

6. A printer according to claim 1, 2 or 3, wherein said second advance means includes two ratchet wheels for moving said ribbon in forward and reverse directions, and further including a pair of pivotal arms connected to the connecting means for said second advance means, a pair of elongated lateral bars attached to respective ones of said arms, each of said bars including pawl means, and means for selectively moving one of said bars and its pawl means into operating engagement with one of said ratchet wheels.

7. A printer according to claim 1, 2 or 3, wherein said second advance means includes two ratchet wheels for moving said ink bearing member in forward and reverse directions, and further including a pair of pivotal arms connected to the web means associated with said second advance means, a pair of elongated lateral bars attached to respective ones of said arms, each of said bars including pawl means, and means for selectively moving one of said bars and its pawl means into operating engagement with one of said ratchet wheels, said means for selectively moving including a slide bar containing camming surfaces for engaging said lateral bars, said ink bearing member including means for moving said slide bar as said ink bearing means approaches the end of its travel in either direction.

* * * * *